US008146758B1

(12) United States Patent
Peres

(10) Patent No.: US 8,146,758 B1
(45) Date of Patent: Apr. 3, 2012

(54) COMPARTMENTALIZED BABY BOTTLE AND ASSOCIATED METHOD

(76) Inventor: Travis Peres, Palm Bay, FL (US)

( * ) Notice: Subject to any disclaimer, the term of this patent is extended or adjusted under 35 U.S.C. 154(b) by 78 days.

(21) Appl. No.: 12/381,123

(22) Filed: Mar. 6, 2009

Related U.S. Application Data

(60) Provisional application No. 61/068,374, filed on Mar. 7, 2008.

(51) Int. Cl.
*A61J 9/00* (2006.01)
*B65D 1/04* (2006.01)
*B65D 25/08* (2006.01)

(52) U.S. Cl. ..... 215/6; 215/11.1; 215/DIG. 6; 206/219

(58) Field of Classification Search ..... 215/11.1, 215/6, DIG. 8, 11.4; 206/219, 221, 222; 220/521
See application file for complete search history.

(56) References Cited

U.S. PATENT DOCUMENTS

| | | | | | |
|---|---|---|---|---|---|
| 1,098,653 | A | * | 6/1914 | Whisenant | 215/386 |
| 2,372,281 | A | * | 3/1945 | Jordan | 215/11.5 |
| 2,431,543 | A | * | 11/1947 | Collins | 222/142.8 |
| 2,786,769 | A | * | 3/1957 | Greenspan | 426/117 |
| 3,402,855 | A | | 9/1968 | Schroeder et al. | |
| 3,613,955 | A | | 10/1971 | Wetherell | |
| 4,311,318 | A | * | 1/1982 | Czernik et al. | 277/598 |
| 4,779,722 | A | * | 10/1988 | Hall | 206/221 |
| 4,823,946 | A | | 4/1989 | Stoeffler | |
| 4,856,995 | A | * | 8/1989 | Wagner | 433/215 |
| 4,979,629 | A | * | 12/1990 | Askerneese | 215/11.1 |
| 5,085,330 | A | * | 2/1992 | Paulin | 215/6 |
| 5,123,574 | A | * | 6/1992 | Poulos | 222/362 |
| 5,353,964 | A | * | 10/1994 | Liu et al. | 222/134 |
| 5,361,918 | A | | 11/1994 | Mason | |
| 5,692,644 | A | * | 12/1997 | Gueret | 222/80 |
| 5,794,802 | A | | 8/1998 | Caola | |
| 6,045,254 | A | * | 4/2000 | Inbar et al. | 366/130 |
| 6,705,491 | B1 | * | 3/2004 | Lizerbram et al. | 222/145.1 |
| 6,910,573 | B2 | | 6/2005 | Deans | |
| 7,083,043 | B2 | * | 8/2006 | Sharon | 206/221 |
| 7,098,431 | B2 | * | 8/2006 | Chia Salido et al. | 219/725 |
| 7,150,369 | B1 | * | 12/2006 | Fryar | 215/11.4 |
| 2004/0089563 | A1 | * | 5/2004 | Sharon et al. | 206/219 |
| 2004/0173634 | A1 | * | 9/2004 | Pagovich et al. | 222/158 |
| 2007/0017890 | A1 | * | 1/2007 | Al-Jadh | 215/11.1 |
| 2007/0221601 | A1 | * | 9/2007 | Eitrheim et al. | 215/6 |
| 2008/0142030 | A1 | * | 6/2008 | Venere et al. | 132/116 |
| 2009/0178940 | A1 | * | 7/2009 | Said | 206/221 |

FOREIGN PATENT DOCUMENTS

WO WO 2008153965 A1 * 12/2008

* cited by examiner

*Primary Examiner* — Sue Weaver

(57) ABSTRACT

A compartmentalized baby bottle includes main and secondary interior compartments for housing and selectively introducing a soluble mix to a fluid, as needed by the caregiver. A plurality of conduits are formed along a bottom-most end of the main interior compartments for allowing the soluble mix to pass therethrough. A conduit-sealing mechanism is provided such that a care giver is permitted to selectively combine the mix and fluid together without prematurely exposing the mix. Advantageously, the conduit-sealing is selectively biased between open and closed positions for preventing the fluid and mix from undesirably mixing together until the care giver is ready to do same.

14 Claims, 6 Drawing Sheets

COMPARTMENTALIZED BABY BOTTLE AND ASSOCIATED METHOD

CROSS REFERENCE TO RELATED APPLICATIONS

This application claims the benefit of provisional patent application Ser. No. 61/068,374, filed Mar. 7, 2008, the entire disclosure of which is incorporated herein by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to baby bottles and, more particularly, to a compartmentalized baby bottle for selectively introducing a granular or powder mix to a fluid contained in a main compartment.

2. Prior Art

There are many circumstances which necessitate keeping ingredients separated in a container until they are ready to be mixed and dispensed. As an example, when using powdered baby formula, it is necessary to mix the formula with water, thereby producing a milky liquid which is consumed by infants and small children. Once the formula is mixed, it must be consumed within a short period of time or refrigerated.

Typically, when traveling with an infant, feeding times are not precisely known and infants are fed on demand. The feeding time is normally indicated by urgent cries from the child and it is important not to delay. Many times, the infant will not eat if it is too upset. On the road, feeding a child using powdered formula can get complicated and messy as you have to measure the required amount of formula from a can and pour this into a baby bottle containing water. Formula can be mixed ahead of time and stored in a portable insulated carrier but the formula should be consumed within two hours.

This time can be extended by placing an ice pack with the formula. Any time formula is refrigerated, it is usually necessary to heat it to at least room temperature before it is consumed. Even as the child develops and feeding times are easier to plan, it can be very difficult to feed the child while on the road. Considering the number of bottles a child consumes in a day, any apparatus designed to assist the parent in feeding should be easy to clean and relatively inexpensive. Obviously, it would be advantageous to provide a baby bottle that addresses all of these concerns.

Accordingly, the present invention is disclosed in order to overcome the above noted shortcomings. The compartmentalized baby bottle is convenient and easy to use, lightweight yet durable in design, and designed for introducing a granular or powder mix to a fluid contained in a main compartment. The assembly is simple to use, inexpensive, and designed for many years of repeated use.

BRIEF SUMMARY OF THE INVENTION

In view of the foregoing background, it is therefore an object of the present invention to provide an apparatus for compartmentalized baby bottle for selectively introducing a soluble mix to a predetermined quantity of fluid as desired by the user.

These and other objects, features, and advantages of the invention are provided by a compartmentalized baby bottle is shown for storing and selectively introducing a soluble mix to a predetermined quantity of fluid. The compartmentalized baby bottle preferably includes a main interior compartment adapted to receive and hold the fluid therein. Such a main interior compartment preferably has a plurality of conduits formed therein. Also, a top nipple section is removably connected to the main interior compartment for dispensing the fluid mixture during use.

The present invention further includes a secondary interior compartment spaced apart from the main interior compartment and adapted to receive and hold the soluble mix therein. Notably, a conduit-sealing mechanism is provided for selectively maintaining the main interior compartment initially isolated from the secondary interior compartment during non-operating conditions.

Such a conduit-sealing mechanism is intermediately and removably coupled to the main and secondary interior compartments respectively such that one of the main and secondary interior compartments remains statically affixed to the conduit-sealing mechanism while another one of the main and secondary interior compartments is independently separated from the conduit-sealing mechanism respectively. In this manner, a user can remove the secondary interior compartment and refill it with formula powder without having to empty the fluid contained within the main interior compartment.

In a preferred embodiment, the conduit-sealing mechanism may further comprise a body removably coupled to a bottom-most end of the main interior compartment and a top-most end of the secondary interior compartment. A divider is statically conjoined to an interior perimeter of the body and centrally positioned therein. Such a divider may be provided with a first plurality of openings formed therein.

The conduit-sealing mechanism further includes an activation switch is slidably interfitted inside the body in such a manner that the activation sits on top of the divider. The activation switch may be provided with a second plurality of openings selectively aligned with the first plurality of openings respectively. The activation switch is suitably sized and shaped to be positioned on the divider and freely rotates along an arcuate path defined about a longitudinal axis passing through the divider.

Advantageously, the first plurality of openings are in fluid communication with the conduits when the activation switch is biased to an open position. In this manner, the open position is defined when the second plurality of openings are axially aligned with the first plurality of openings and the conduits respectively. Alternately, the first plurality of openings are isolated from the conduits when the activation switch is biased to a closed position. The closed position is defined when the second plurality of openings are axially offset from the first plurality of openings and the conduits respectively.

As can be appreciated, the activation switch is rotatably biased within the body and thereby selectively adjusted between the open and closed positions respectively so that the care giver can selectively permit mixture of the soluble mix and fluid, as desired.

In one embodiment, each of the conduits and the first plurality of openings are formed along a unique quadrant of the main interior compartment and the divider respectively such that the first plurality of openings and the conduits are selectively aligned when the divider is rotated between the open and closed positions respectively.

The body is provided with a plurality of slots formed along an outer perimeter thereof so that the activation switch is selectively displaced along the slots when biased between the open and closed positions respectively. Such a feature allows the care giver to accurately align the conduits and first plurality of openings, as needed.

In one embodiment, the divider bifurcates the body into a pair of cavities. Such cavities are identified as a first cavity extending from the first plurality of openings and terminating at the conduits respectively, and a second cavity extending from the first plurality of openings and terminating at a bottom-most end of the secondary interior compartment respectively. In this manner, the second cavity is in fluid communication with the main interior compartment when the second plurality of openings are aligned with the first plurality of openings.

The present invention further includes a method for storing and selectively introducing a soluble mix to a predetermined quantity of fluid. Such a method preferably includes the chronological steps of: providing a main interior compartment having a plurality of conduits formed therein; providing and removably connecting a top nipple section to the main interior compartment; providing and spacing apart a secondary interior compartment from the main interior compartment; and providing a conduit-sealing mechanism.

The method may further includes the chronological steps of: selectively maintaining the main interior compartment initially isolated from the secondary interior compartment during non-operating conditions by intermediately and removably coupling the conduit-sealing mechanism to the main and secondary interior compartments respectively; adapting the conduit-sealing mechanism to a closed position; and depositing the fluid into the main interior compartment.

The method may further include the chronological steps of: maintaining one of the main and secondary interior compartments statically affixed to the conduit-sealing mechanism while independently separating another one of the main and secondary interior compartments from the conduit-sealing mechanism respectively; depositing the soluble mix into the secondary interior compartment; and introducing the soluble mix to the fluid by adapting the conduit-sealing mechanism to an open position and repeatedly inverting the compartmentalized baby bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
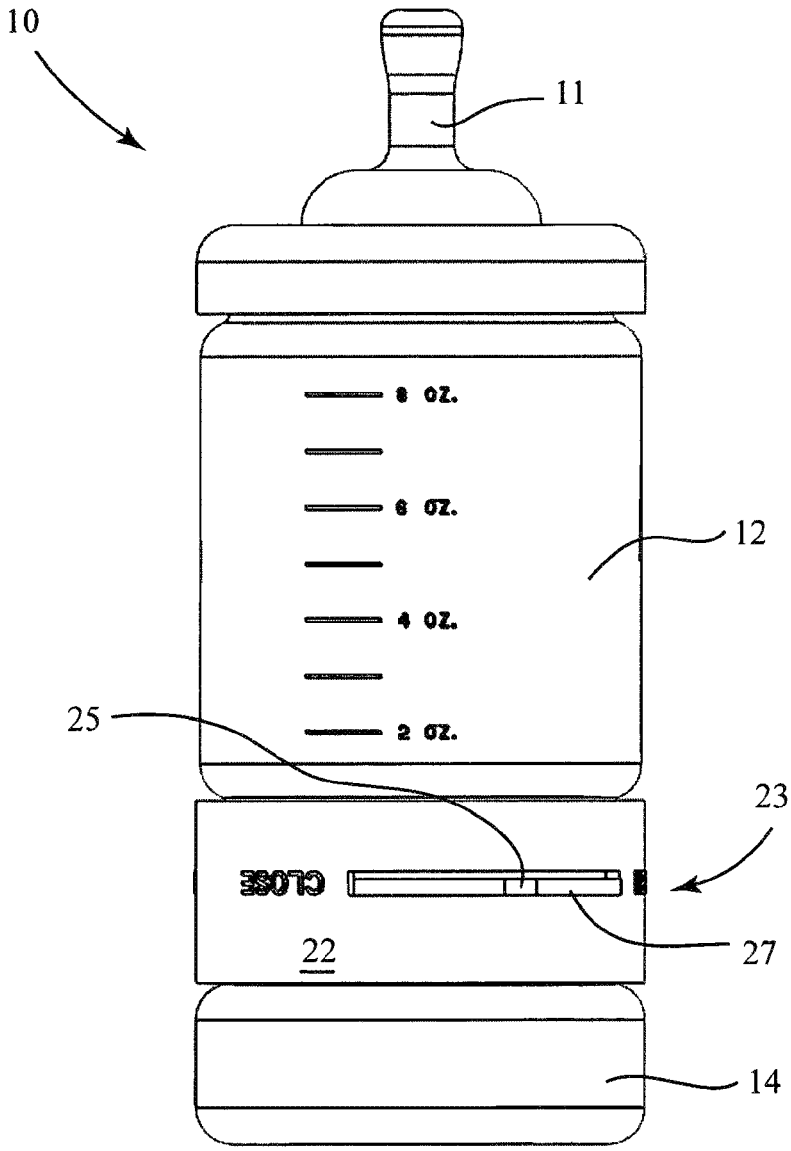
FIG. 1 is a front elevational view of a compartmentalized baby bottle, in accordance with the present invention.
Figure 2:
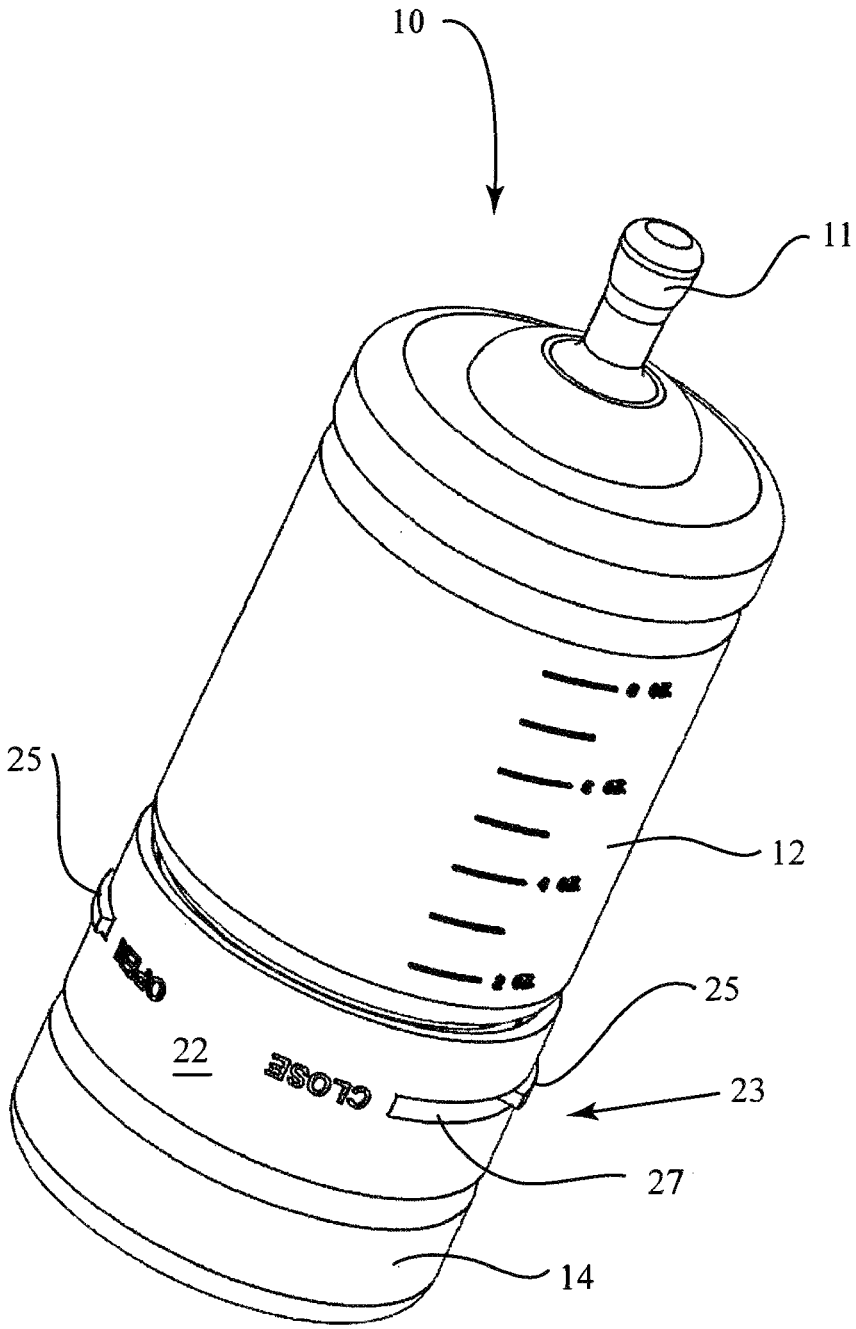
FIG. 2 is a perspective view of FIG. 1.
Figure 3:
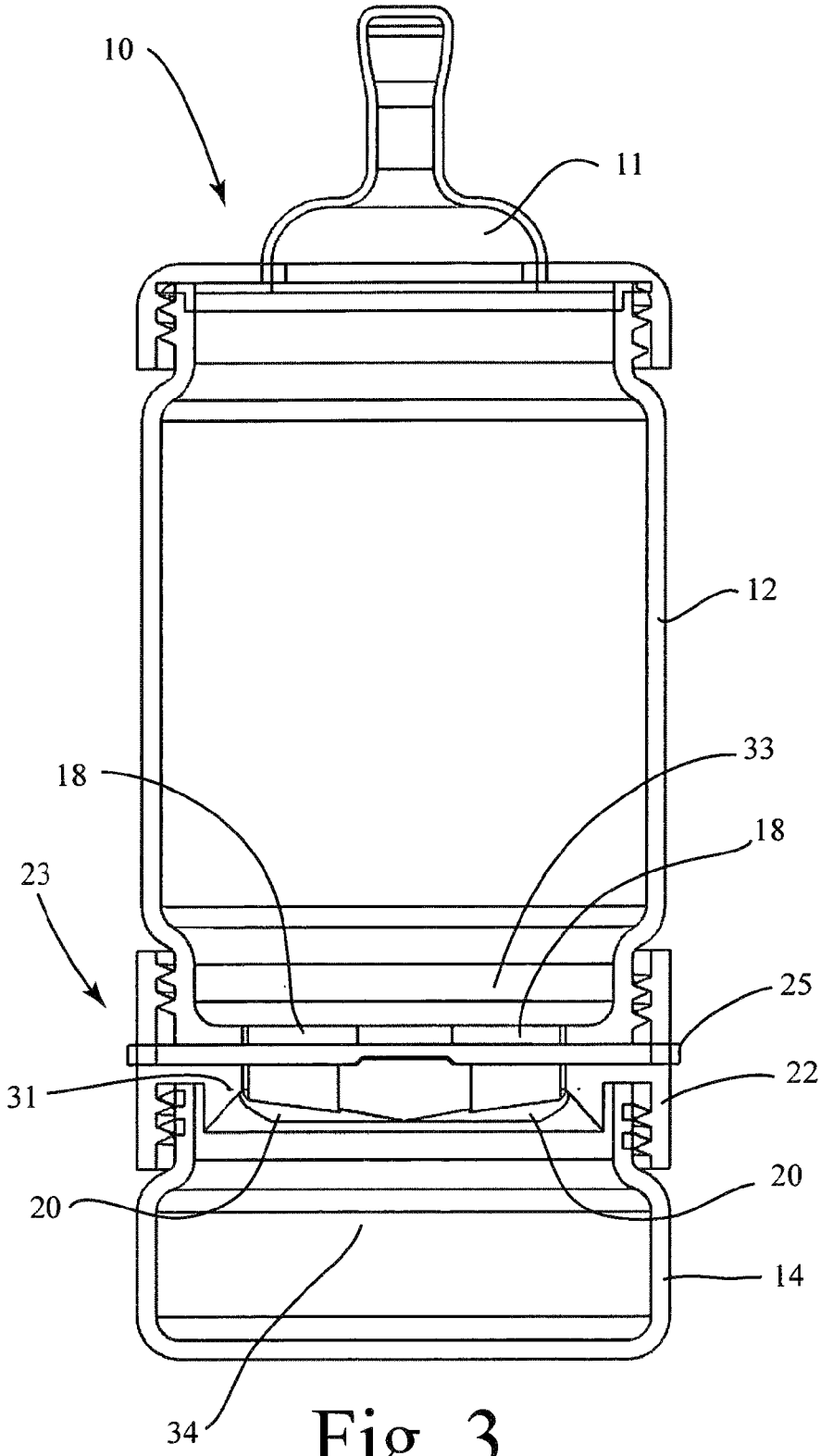
FIG. 3, is a cross-sectional view of FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The assembly of this invention is referred to generally in the figures and is intended to provide a compartmentalized baby bottle. It should be understood that the assembly may be used to separate many different types of ingredients for future combination and should not be limited to use in separating only those types of ingredients mentioned herein.

Referring to FIGS. 1-6, a compartmentalized baby bottle 10 is shown for storing and selectively introducing a soluble mix to a predetermined quantity of fluid. The compartmentalized baby bottle 10 preferably includes a main interior compartment 12 adapted to receive and hold the fluid therein. Such a main interior compartment 12 preferably has a plurality of conduits 18 formed therein. Also, a top nipple section 11 is removably connected to the main interior compartment 12 for dispensing the fluid mixture during use.

The present invention 10 further includes a secondary interior compartment 14 spaced apart from the main interior compartment 12 and adapted to receive and hold the soluble mix therein. Notably, a conduit-sealing mechanism 23 is provided for selectively maintaining the main interior compartment 12 initially isolated from the secondary interior compartment 14 during non-operating conditions. Such a conduit-sealing mechanism 23 is intermediately and removably coupled to the main and secondary interior compartments 12, 14 respectively such that one of the main and secondary interior compartments 12, 14 remains statically affixed to the conduit-sealing mechanism 23 while another one of the main and secondary interior compartments 12, 14 is independently separated from the conduit-sealing mechanism 23 respectively. In this manner, a user can remove the secondary interior compartment 14 and refill it with formula powder without having to empty the fluid contained within the main interior compartment 12.

Figure 4:
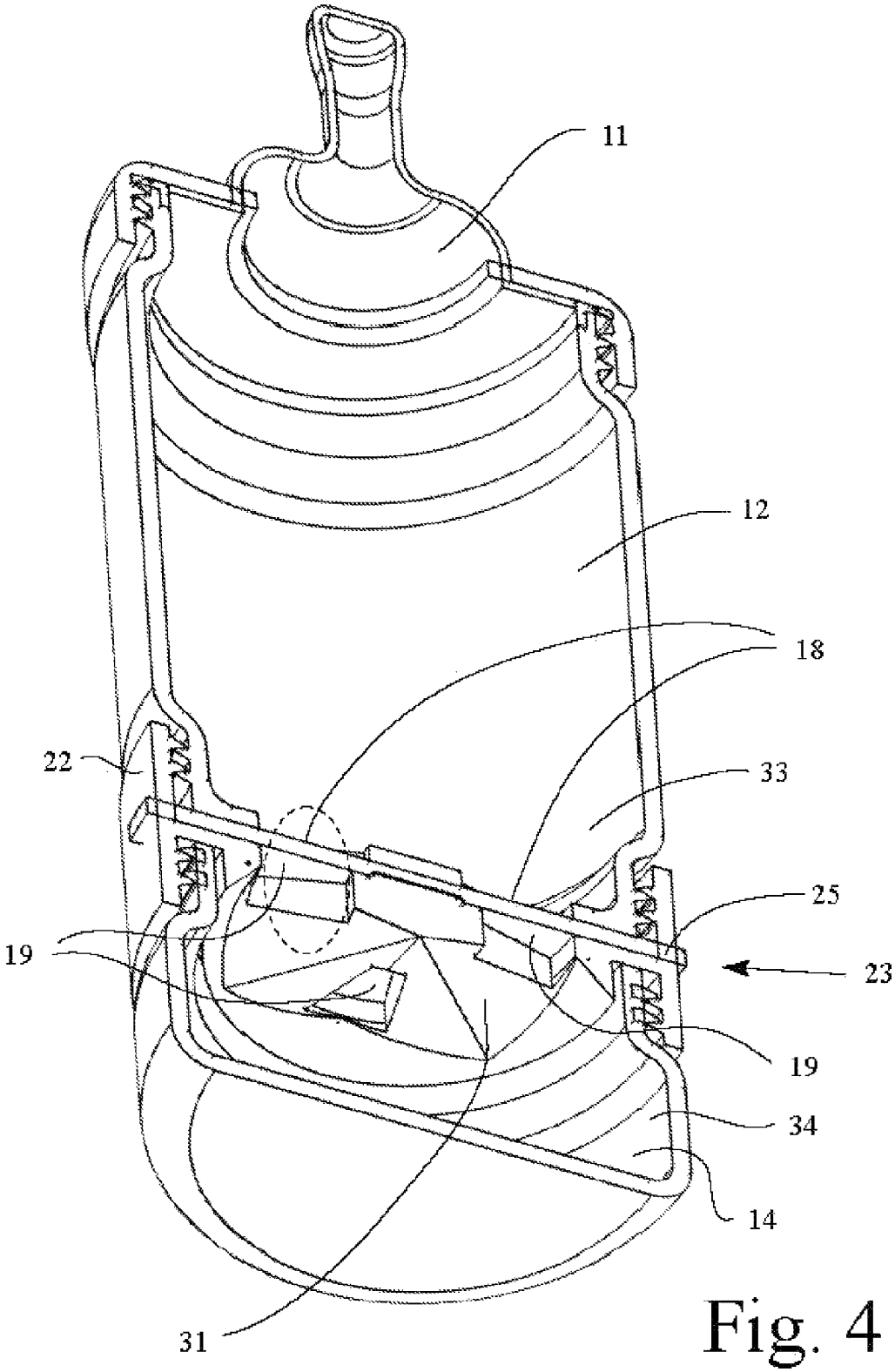
FIG. 4 is a cross-sectional view of figure of FIG. 2, with the present invention rotated on an alternate axis.
Figure 5:
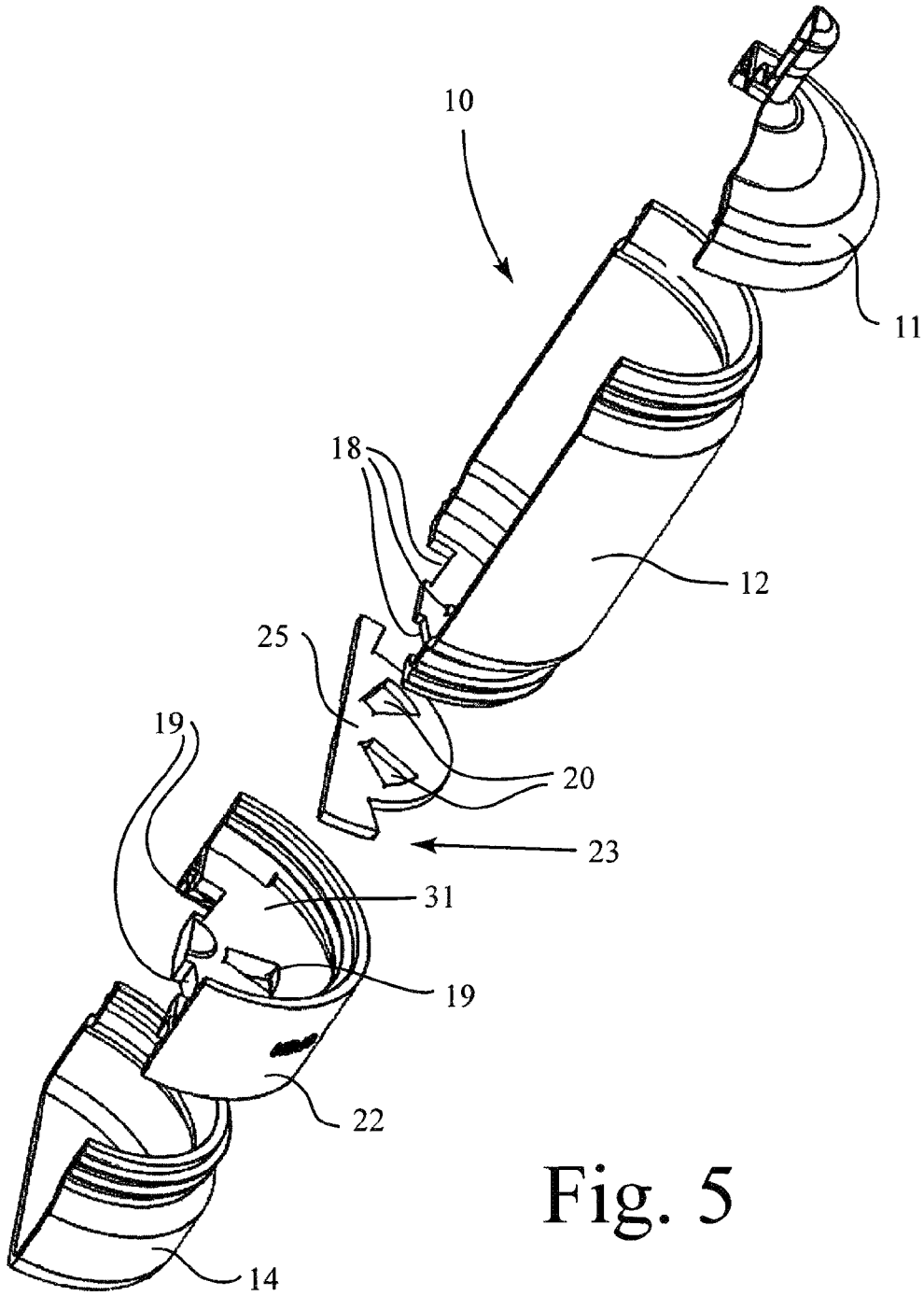
FIG. 5 is an exploded view of FIG. 4, with the present invention rotated on an alternate axis.
Figure 6:
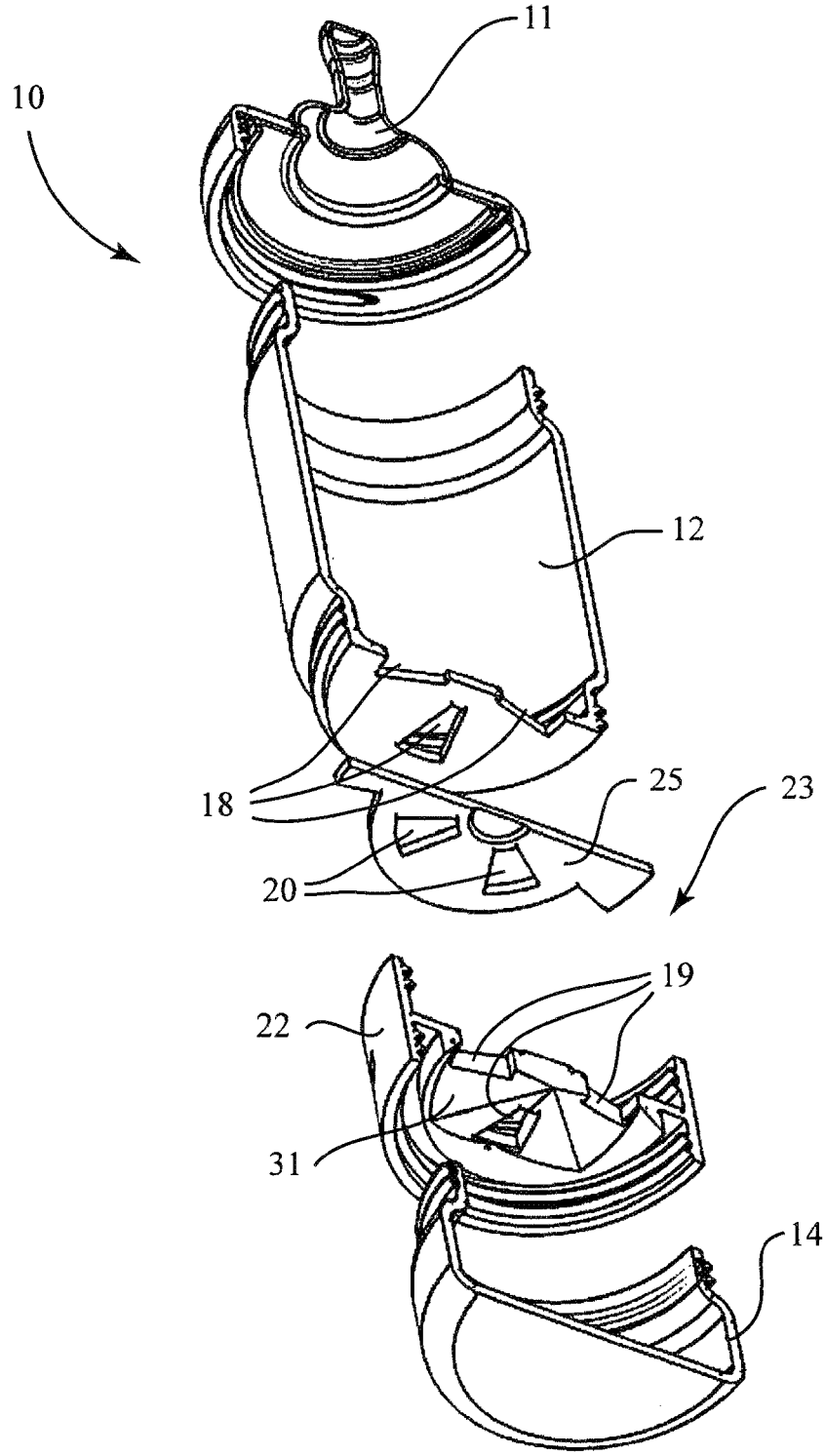
FIG. 6 is an exploded view of FIG. 4, with the present invention rotated on yet another axis.

In a preferred embodiment, the conduit-sealing mechanism 23 may comprise a body 22 removably coupled to a bottom-most end of the main interior compartment 12 and a top-most end of the secondary interior compartment 14, as perhaps best shown in FIGS. 4-6. A divider 31 is statically conjoined to an interior perimeter of the body 22 and centrally positioned therein. Such a divider 31 may be provided with a first plurality of openings 19 formed therein.

The conduit-sealing mechanism 23 further includes an activation switch 25 is slidably interfitted inside the body 22 in such a manner that the activation switch 25 sits on top of the divider 31. The activation switch 25 may be provided with a second plurality of openings 20 selectively aligned with the first plurality of openings 19 respectively. The activation switch 25 is suitably sized and shaped to be positioned on the divider 31 and freely rotates along an arcuate path defined about a longitudinal axis passing through the divider 31.

Advantageously, the first plurality of openings 19 are in fluid communication with the conduits 18 when the activation switch 25 is biased to an open position. In this manner, the open position is defined when the second plurality of openings 20 are axially aligned with the first plurality of openings 19 and the conduits 18, respectively. Alternately, the first plurality of openings 19 are isolated from the conduits 18 when the activation switch 25 is biased to a closed position. The closed position is defined when the second plurality of openings 20 are axially offset from the first plurality of openings 19 and the conduits 18, respectively.

As can be appreciated, the activation switch 25 is rotatably biased within the body 22 and thereby selectively adjusted between the open and closed positions respectively so that the care giver can selectively permit mixture of the soluble mix and fluid, as desired. The divider 31 remains statically seated inside body 22 while activation switch 25 is rotatably biased between the open and closed positions. The activation switch 25 is removable from the body 22 so that it can be cleaned during periodic maintenance.

As perhaps best shown in FIGS. 4-6, each of the conduits 18 and the first plurality of openings 19 are formed along a unique quadrant of the main interior compartment 12 and the divider 31, respectively, such that the first plurality of openings 19 and the conduits 18 are selectively aligned when the divider 31 is rotated between the open and closed positions respectively.

The body 22 is provided with a plurality of slots 27 formed along an outer perimeter thereof so that the activation switch 25 is selectively displaced along the slots 27 when biased between the open and closed positions respectively. Such a feature allows the care giver to accurately align the conduits 18 and first plurality of openings 19, as needed, while body 22 is connected to the main and secondary interior compartments 12, 14.

In one embodiment, the divider 31 bifurcates the body 22 into a pair of cavities. As perhaps best shown in FIG. 3, such cavities are identified as a first cavity 33 extending from the first plurality of openings 19 and terminating at the conduits 18 respectively, and a second cavity 34 extending from the first plurality of openings 19 and terminating at a bottommost end of the secondary interior compartment 14, respectively. In this manner, the second cavity 34 is in fluid communication with the main interior compartment 12 when the second plurality of openings 20 are aligned with the first plurality of openings 19.

The present invention 10 further includes a method for storing and selectively introducing a soluble mix to a predetermined quantity of fluid. Such a method preferably includes the chronological steps of: providing a main interior compartment 12 having a plurality of conduits 18 formed therein; providing and removably connecting a top nipple section 11 to the main interior compartment 12; providing and spacing apart a secondary interior compartment 14 from the main interior compartment 12; and providing a conduit-sealing mechanism 23.

The method may further includes the chronological steps of: selectively maintaining the main interior compartment 12 initially isolated from the secondary interior compartment 14 during non-operating conditions by intermediately and removably coupling the conduit-sealing mechanism 23 to the main and secondary interior compartments 12, 14, respectively; adapting the conduit-sealing mechanism 23 to a closed position; and depositing the fluid into the main interior compartment 12.

The method may further include the chronological steps of: maintaining one of the main and secondary interior compartments 12, 14 statically affixed to the conduit-sealing mechanism 23 while independently separating another one of the main and secondary interior compartments 12, 14 from the conduit-sealing mechanism 23 respectively; depositing the soluble mix into the secondary interior compartment 14; and introducing the soluble mix to the fluid by adapting the conduit-sealing mechanism 23 to an open position and repeatedly inverting the compartmentalized baby bottle 10.

In an alternate embodiment, the activation switch 25 is inserted into one of two slots 27 located centrally on the conduit sealing mechanism 23. This switch 25 will include a plurality of slots 27 for enabling fluid and powder to pass through when slid into an "on" position. The activation switch 25 is slid along the slots 27 of the conduit sealing mechanism 23 as far as it will go and then pressed against the bottom of the mechanism 23. The switch 25 is then slid back through the slots 27 on the other side of the mechanism 23 until it is approximately centered. This activation switch 25 is removable in order to facilitate easy cleaning procedures. The secondary interior compartment 14 is then attached to the conduit sealing mechanism 23 and tightened. The activation switch 25 will center itself during this process.

Next, the activation switch 25 is manually moved along the slots 27 until the activation switch 25 seals all of the conduits 18 at the main interior compartment. When the switch is in an "off" position, a tightened and enhanced seal will prevent leakage between the main and secondary interior compartments 12, 14. Then, fluid may be added to the main interior compartment 12 and sealed with the nipple section 11 of the assembly 10. Powder is placed within the secondary interior compartment 14, and the units are now available for storage/transportation, etc.

When a bottle is ready for feeding or other purposes, a user should remove the secondary interior compartment 14 from a sterile seal. The secondary interior compartment 14 is then placed under the conduit sealing mechanism 23 and screwed onto the assembly 10. The entire assembly 10 in then turned upside down so that the secondary interior compartment 14 is located at the top of the assembly 10. The activation switch 25 is then rotated to an open position. This allows the powder to flow into the main compartment 12 via gravity.

The activation switch 25 has some funneling features to assist in getting all the powder through the conduits 18, but the assembly 10 may be tapped a few times at the end of the filtering process to ensure that all of the powder flows through. The activation switch 25 is then turned to close the conduits 18, and the secondary interior compartment 14 may be removed. Finally, the main interior compartment 12 is shaken in order to thoroughly mix the formula.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A compartmentalized baby bottle for storing and selectively introducing a soluble mix to a predetermined quantity of fluid, said compartmentalized baby bottle comprising:

a main interior compartment adapted to receive and hold the fluid therein, said main interior compartment having a plurality of conduits formed therein;

a secondary interior compartment spaced apart from said main interior compartment and being adapted to receive and hold the soluble mix therein; and a conduit-sealing means for selectively maintaining said main interior compartment initially isolated from said secondary interior compartment during non-operating conditions;

wherein said conduit-sealing means is intermediately and removably coupled to said main and secondary interior compartments respectively, said conduit-sealing means being arranged in such a manner that one of said main and secondary interior compartments remains statically affixed to said conduit-sealing means while another one of said main and secondary interior compartments is independently separated from said conduit-sealing means respectively;

wherein said conduit-sealing means comprises a body removably coupled to a bottom-most end of said main interior compartment and a top-most end of said secondary interior compartment;

a divider statically conjoined to an interior perimeter of said body and being centrally positioned therein, said divider being provided with a first plurality of openings formed therein; and an activation switch slidably interfitted inside said body in such a manner that said activation switch sits on top of said divider, said activation switch being provided with a second plurality of openings selectively aligned with said first plurality of openings respectively;

wherein said activation switch is suitably sized and shaped to be positioned on said divider and freely rotated along an arcuate path defined about a longitudinal axis passing through said divider.

2. The compartmentalized baby bottle of claim 1, wherein said first plurality of openings are in fluid communication with said conduits when said activation switch is rotated to an open position, wherein said open position is defined when said second plurality of openings are axially aligned with said first plurality of openings and said conduits respectively.

3. The compartmentalized baby bottle of claim 2, wherein said first plurality of openings are isolated from said conduits when said activation switch is rotated to a closed position, wherein said closed position is defined when said second plurality of openings are axially offset from said first plurality of openings and said conduits respectively.

4. The compartmentalized baby bottle of claim 3, wherein said activation switch is rotatably rotated within said body and thereby selectively adjusted between said open and closed positions respectively.

5. The compartmentalized baby bottle of claim 4, wherein each of said conduits are formed along a unique quadrant of said main interior compartment and said first plurality of openings are formed along said divider respectively such that said first plurality of openings and said conduits are selectively aligned while said activation switch is rotated between the open and closed positions respectively.

6. The compartmentalized baby bottle of claim 5, wherein said body is provided with a plurality of slots formed along an outer perimeter thereof, said activation switch being selectively displaced along said slots when rotated between said open and closed positions respectively.

7. The compartmentalized baby bottle of claim 1, wherein said divider bifurcates said body into a pair of cavities comprising:

a first cavity extending from said first plurality of openings and terminating at said conduits respectively; and a second cavity extending from said first plurality of openings and terminating at a bottom-most end of said secondary interior compartment respectively;

wherein said second cavity is in fluid communication with said main interior compartment when said second plurality of openings are aligned with said first plurality of openings.

8. A compartmentalized baby bottle for storing and selectively introducing a soluble mix to a predetermined quantity of fluid, said compartmentalized baby bottle comprising:

a main interior compartment adapted to receive and hold the fluid therein, said main interior compartment having a plurality of conduits formed therein;

a top nipple section removably connected to said main interior compartment;

a secondary interior compartment spaced apart from said main interior compartment and being adapted to receive and hold the soluble mix therein; and a conduit-sealing means for selectively maintaining said main interior compartment initially isolated from said secondary interior compartment during non-operating conditions;

wherein said conduit-sealing means is intermediately and removably coupled to said main and secondary interior compartments respectively, said conduit-sealing means being arranged in such a manner that one of said main and secondary interior compartments remains statically affixed to said conduit-sealing means while another one of said main and secondary interior compartments is independently separated from said conduit-sealing means respectively;

wherein said conduit-sealing means comprises a body removably coupled to a bottom-most end of said main interior compartment and a top-most end of said secondary interior compartment;

a divider statically conjoined to an interior perimeter of said body and being centrally positioned therein, said divider being provided with a first plurality of openings formed therein; and an activation switch slidably interfitted inside said body in such a manner that said activation switch sits on top of said divider, said activation switch being provided with a second plurality of openings selectively aligned with said first plurality of openings respectively;

wherein said activation switch is suitably sized and shaped to be positioned on said divider and freely rotated along an arcuate path defined about a longitudinal axis passing through said divider.

9. The compartmentalized baby bottle of claim 8, wherein said first plurality of openings are in fluid communication with said conduits when said activation switch is rotated to an open position, wherein said open position is defined when said second plurality of openings are axially aligned with said first plurality of openings and said conduits respectively.

10. The compartmentalized baby bottle of claim 9, wherein said first plurality of openings are isolated from said conduits when said activation switch is rotated to a closed position, wherein said closed position is defined when said second plurality of openings are axially offset from said first plurality of openings and said conduits respectively.

11. The compartmentalized baby bottle of claim 10, wherein said activation switch is rotatably rotated within said body and thereby selectively adjusted between said open and closed positions respectively.

12. The compartmentalized baby bottle of claim 11, wherein each of said conduits are formed along a unique quadrant of said main interior compartment and said first plurality of openings are formed along said divider respectively such that said first plurality of openings and said conduits are selectively aligned while said activation switch is rotated between the open and closed positions respectively.

13. The compartmentalized baby bottle of claim 12, wherein said body is provided with a plurality of slots formed along an outer perimeter thereof, said activation switch being selectively displaced along said slots when rotated between said open and closed positions respectively.

14. The compartmentalized baby bottle of claim 8, wherein said divider bifurcates said body into a pair of cavities comprising:

a first cavity extending from said first plurality of openings and terminating at said conduits respectively; and a second cavity extending from said first plurality of openings and terminating at a bottom-most end of said secondary interior compartment respectively;

wherein said second cavity is in fluid communication with said main interior compartment when said second plurality of openings are aligned with said first plurality of openings.

* * * * *